US007624866B2

(12) United States Patent
Wang

(10) Patent No.: US 7,624,866 B2
(45) Date of Patent: Dec. 1, 2009

(54) STORAGE BOX

(75) Inventor: Qibin Wang, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 442 days.

(21) Appl. No.: 11/405,246

(22) Filed: Apr. 17, 2006

(65) Prior Publication Data

US 2006/0283739 A1 Dec. 21, 2006

(30) Foreign Application Priority Data

Apr. 18, 2005 (CN) ..... 2005 2 0016547 U

(51) Int. Cl.
*B65D 85/28* (2006.01)
*A45C 11/26* (2006.01)
*A47F 7/00* (2006.01)

(52) U.S. Cl. ..... 206/379; 206/372; 206/818; 206/349; 206/350; 211/69

(58) Field of Classification Search ..... 206/370, 206/372–380, 349, 350, 818, 230, 229, 736–739, 206/754, 751, 756–759; 211/70.6, 69, 70; 221/154, 255–257, 151, 121, 122
See application file for complete search history.

(56) References Cited

U.S. PATENT DOCUMENTS 2,573,311 A * 10/1951 Cupler ..... 312/73
D370,626 S * 6/1996 Pass et al. ..... D9/415
5,868,251 A 2/1999 Lin
5,941,430 A * 8/1999 Kuwabara ..... 223/109 R
6,186,349 B1 * 2/2001 Tempongko ..... 220/4.22
6,631,825 B2 * 10/2003 Garrant et al. ..... 221/79
6,910,578 B2 * 6/2005 Stern ..... 206/379
7,232,041 B2 * 6/2007 Ferguson et al. ..... 221/239
7,261,211 B2 * 8/2007 Robins ..... 211/70.6
2004/0060838 A1 4/2004 Yu

FOREIGN PATENT DOCUMENTS

DE 202004003905 4/2004
DE 20318541 4/2005
EP 0 559 105 B1 9/1993
EP 0559105 9/1993
GB 2 350 604 A 12/2000

OTHER PUBLICATIONS

Search Report for International Patent Application No. EP 06252029.1.

* cited by examiner

*Primary Examiner*—Jila M Mohandesi
*Assistant Examiner*—Melissa L Lalli
(74) *Attorney, Agent, or Firm*—Howard & Howard Attorneys PLLC

(57) ABSTRACT

A storage box for storing power tool bits comprises a container, a bit holder and a control device. The container defines a compartment in which is received the bit holder along a common rotary axis. The bit holder comprises a plurality of outwardly radial pockets for receiving bits. The control device selectively disengages from the bit holder so that the bit holder is rotational about the common axis to move the bits rotationally in and out of the compartment.

22 Claims, 5 Drawing Sheets

STORAGE BOX

CROSS-REFERENCE TO RELATED APPLICATIONS

The subject patent application claims priority to and all the benefits of Chinese Patent Application No. 200520016547.7, which was filed on Apr. 18, 2005.

FIELD OF THE INVENTION

The present invention relates to a storage box for storing bits of power tools.

BACKGROUND OF THE INVENTION

EP-A-0559105 discloses a storage box which consists of a holder containing a plurality of retaining slots arranged side-by-side to receive screwdriver bits. A hinged lid is pivotally connected to the bit holder. If the capacity of the storage box needs to be increased, the volume of the storage box must be increased which makes it inconvenient to carry. In addition, the hinged lid is provided with a keyhole perpendicular to the rotary axis and the bit holder slides in the keyhole to prevent or allow rotation. However the keyhole is defined in such a way that it further increases the volume of the storage box.

SUMMARY OF THE INVENTION

The primary object of the present invention is to provide a small storage box which can contain more bits.

Another object of the present invention is to provide a storage box which is convenient to use.

Another object of the present invention is to provide a storage box which receive bits securely.

The present invention provides a storage box comprising a container, a bit holder and a control device. The container is provided with a first containing space (e.g. a compartment) and a hole vertically interconnected with the first containing space. The bit holder comprises a plurality of retaining pockets for receiving bits and an aperture. The bit holder is received within the first containing space in such a way that the aperture aligns with the hole of the container to form a second containing space (e.g. bore). The control device is received within the second containing space and is connected to the bit holder so as to swing the bit holder around the axis of the second containing space and the retaining slots in and out.

Viewed from one aspect the present invention provides a storage box for storing a plurality of bits comprising:

a container having at least one annulus bound by a substantially semi-toroidal casing defining a compartment;

a bit holder comprising a generally cylindrical main body with a bore and a plurality of pockets for receiving bits, wherein the bit holder is received within the container such that the bore is aligned with the aperture of the annulus along a common axis; and a control device received within the bore and biased into rotationally restrained engagement with the bit holder, wherein the control device is selectively disengageable from the bit holder so that the bit holder is rotational about the common axis to move the pockets rotationally in and out of the compartment.

Preferably the pockets are outwardly radial or axial.

Preferably the container has a pair of substantially coaxial annuli bound by the substantially semi-toroidal casing defining the compartment, wherein the bit holder is received within the container such that the bore is aligned with the apertures of the annuli along the common axis.

The semi-toroidal casing may have an upper semi-annular wall and a lower semi-annular wall bound in substantially parallel relationship by an arcuate perimeter wall. The common axis is substantially perpendicular to the plane of the bit holder.

In a preferred embodiment, the bit holder comprises: at least one collar bearing the radial pockets in a common plane. Preferably the radial pockets are arranged such that their axes intersect. The retaining pockets may be dimensionally or configurationally the same or different (e.g. to accommodate accessories other than bits).

In a preferred embodiment, a part of the cylindrical main body is a castellated wall and the inner periphery of the cylindrical main body is provided with a cavity wall, wherein an annular slot is formed between the cavity wall and the castellated wall, wherein at least one magnetic element is received in the annular slot for magnetizing the bits. Preferably the magnetic element comprises a flexible rib on which are mounted a plurality of spaced apart (e.g. circumferentially spaced apart) magnets. The ribs may be bent (e.g. arcuate) or straight. The rib may be made of a flexible material such as rubber.

In a preferred embodiment, the control device comprises: a press-button plate movable along the common axis so as to selectively engage or disengage the bit holder. Preferably one of the press-button plate and the bit holder is provided with a projection and the other of the press-button plate and the bit holder is provided with a recess, wherein the press-button plate is movable axially relative to the bit holder in the bore to selectively engage or disengage the projection and the recess.

Preferably the storage box further comprises: an elastic torsion element disposed between the container and the bit holder. The elastic torsion element may be a torsion spring.

Preferably the storage box further comprises: an upper shaft element mounted through an upper annulus of the pair of annuli and a lower shaft element mounted through a lower annulus of the pair of annuli so as to engage the upper shaft element. Particularly preferably the upper shaft element comprises a partial ring-shaped body with a plurality of circumferentially spaced apart tangs extending axially therefrom. Particularly preferably the lower shaft element comprises a disc-shaped body from which axially extends a column defining a plurality of radial protrusions spaced apart to be engageable with the tangs. The tangs may be tapered (e.g. a substantially teardrop profile). The column may have an irregular configuration and is typically multi-walled. The tangs and radial protrusions may hook together.

Preferably the storage box further comprises: two diametrically opposed baffles extending radially outwardly from an exterior wall of the generally cylindrical main body of the bit holder.

Preferably the storage box further comprises: opposed upper and lower semi-annular collars connected to or integral with the cylindrical main body between the baffles. Each collar may be connected to the cylindrical main body by glue or fasteners (such as screws) or may be an integral part of the cylindrical main body. Particularly preferably each of the upper and lower collars comprises a plurality of radial pockets equally spaced apart circumferentially such that their axes intersect. Particularly preferably a part of the cylindrical main body between the baffles is a castellated wall and the inner periphery of the cylindrical main body is provided with a cavity wall, wherein an annular slot is formed between the cavity wall and the castellated wall, wherein at least one magnetic element is received in the annular slot for magnetizing the bits.

Preferably the storage box further comprises: a flexible rib (e.g. an arcuate rib) on which are mounted a plurality of spaced apart (e.g. circumferentially spaced apart) magnets, wherein the flexible rib is mounted in the annular slot such that the magnets separately align with the ends of the radial pockets.

Preferably an inner periphery of the cylindrical main body of the bit holder is provided with a cavity wall having two end recesses and a mounting post or slot formed therein. Particularly preferably the storage box further comprises: an elastic torsion element, wherein a first end of the elastic torsion element is connected to the column and a second end of the elastic torsion element is fixed on to the mounting post or slot to rotationally bias the bit holder about the common axis to a position outside the container.

Preferably the control device extends through the ring-shaped body into the bore and comprises: a press-button plate with two outward projections which are able to selectively disengage the two end recesses.

The press-button plate may be externally accessible. The two outward projections may be substantially diametrically opposed.

Preferably the storage box further comprises: an elastic element disposed axially between the press-button plate and the lower shaft element for biasing the press-button plate upwards and the outward projections into engagement with the recesses, wherein when the press-button plate is pressed downwards to overcome the biasing of the elastic element, the projections disengage the recesses to permit the bit holder to be rotated about the common axis so that the pockets move rotationally into or out of the compartment.

The elastic element is typically retained in the column of the lower shaft element. The elastic element may be secured to the base of the column. Typically the elastic element is a spring.

A clip may be secured to the exterior of the lower shaft element (e.g. by a fastener such as a screw).

DETAILED DESCRIPTION OF THE PREFERRED EMBODIMENTS

Figure 1:
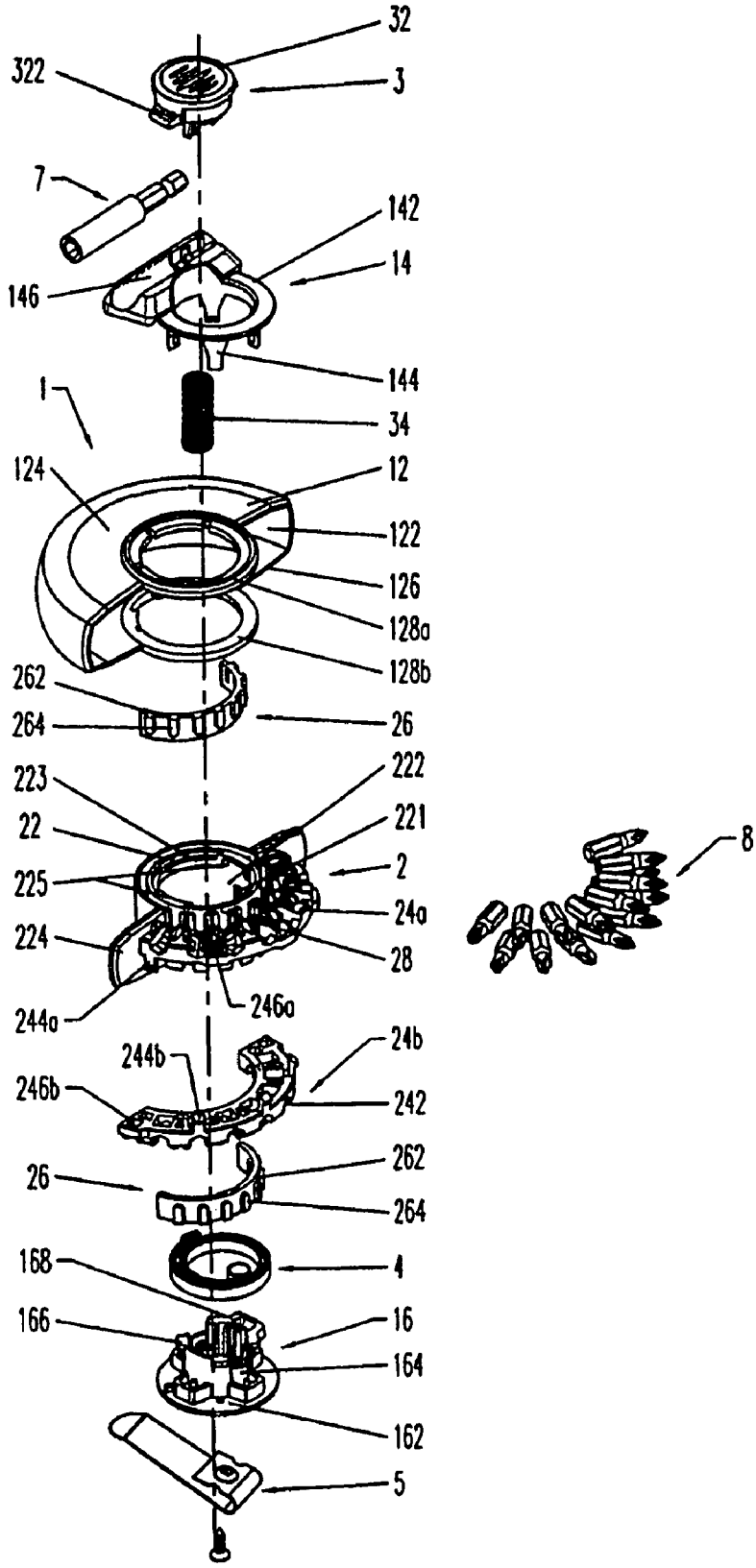
FIG. 1 shows an exploded view of a first embodiment of the present invention.
Figure 3:
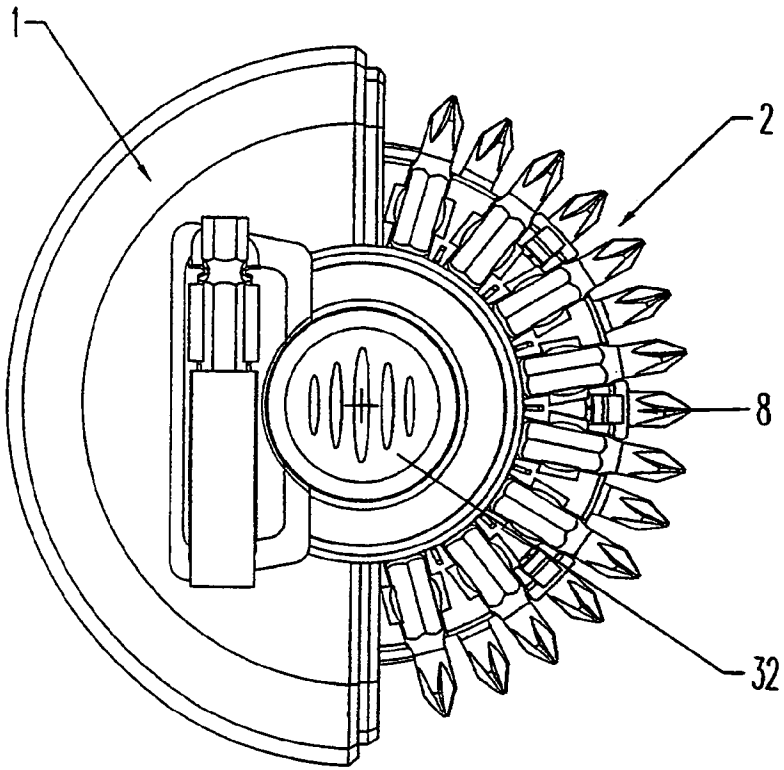
FIG. 3 shows a main view of the first embodiment of the present invention when the bit holder rotates out of the container.
Figure 2:
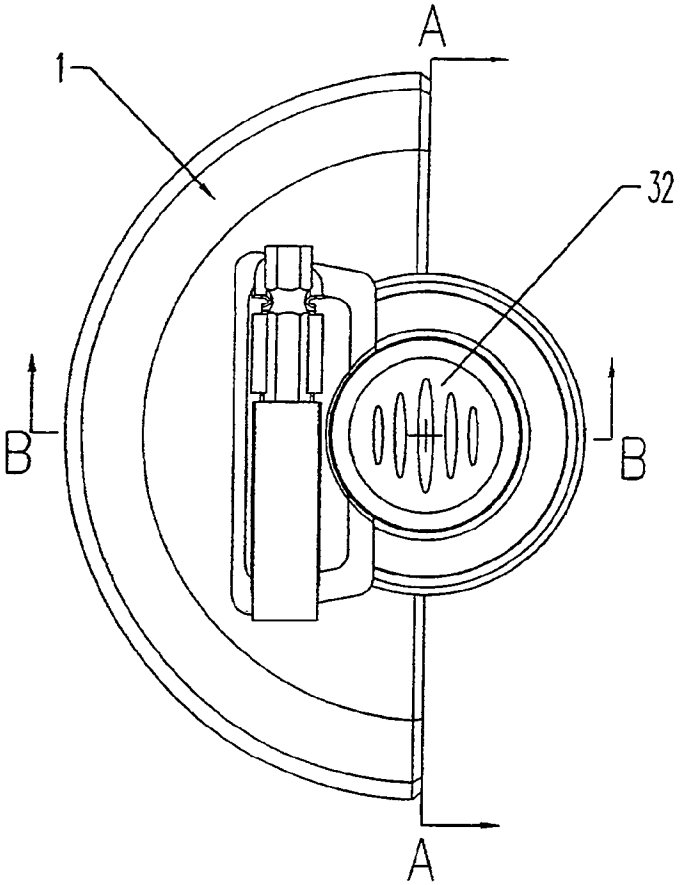
FIG. 2 shows a main view of the first embodiment of the present invention when the bit holder rotates into the container.
Figure 4:
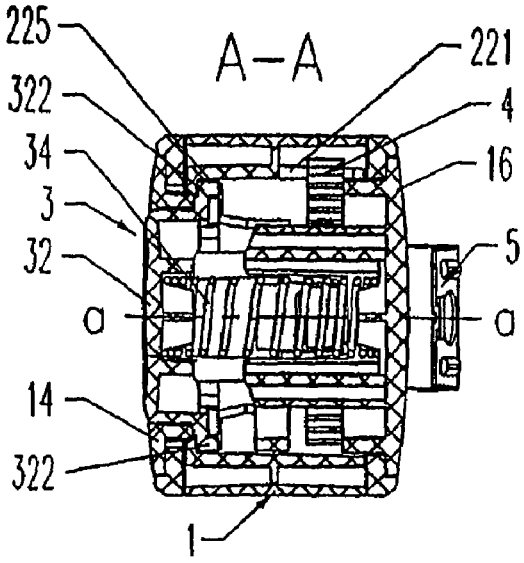
FIG. 4 shows a cross-sectional view along line A-A in FIG. 2 when the press-button plate is in the engaged position.
Figure 5:
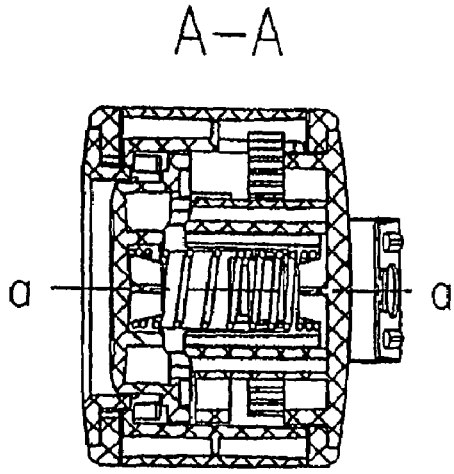
FIG. 5 shows a cross-sectional view similar to FIG. 4 when the press-button plate is in the disengaged position.
Figure 6:
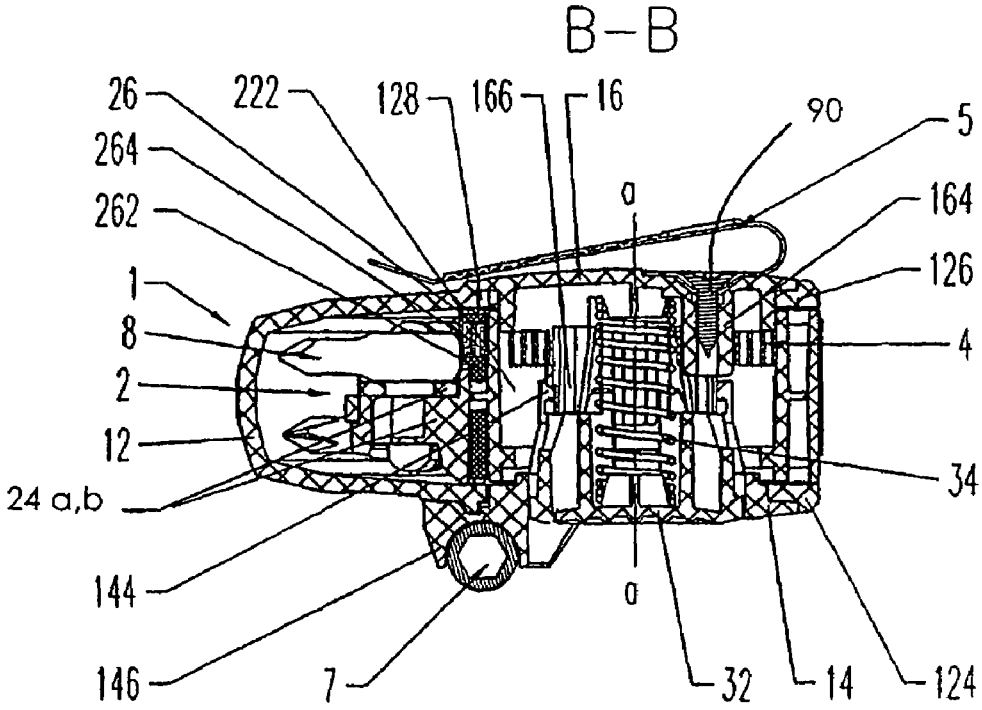
FIG. 6 shows a cross-sectional view along line B-B of FIG. 2.

As shown in FIG. 1, a first embodiment of a storage box of the present invention comprises generally a container 1, a bit holder 2, a control device 3, a torsion spring 4 and a clip 5.

The container 1 comprises a pair of coaxial annuli 128*a,b* bound by a substantially semi-toroidal casing 12 with an upper face 124 and a lower face 126 in which there is a compartment 122.

An upper shaft element 14 is mounted through the annulus 128*a* of the upper face 124 and a lower shaft element 16 is mounted through the annulus 128*b* of the lower face 126. The upper shaft element 14 comprises a partial ring-shaped body 142 with a plurality of circumferentially spaced apart tangs 144 extending axially therefrom and an elongate retaining slot 146 substantially tangential to the ring-shaped body 142 for receiving an elongate bit 7. The lower shaft element 16 comprises a disc-shaped body 162 from which axially extends a column 164 defining a plurality of axial slots 166 spaced apart to be engageable with the tangs 144.

Figure 9:
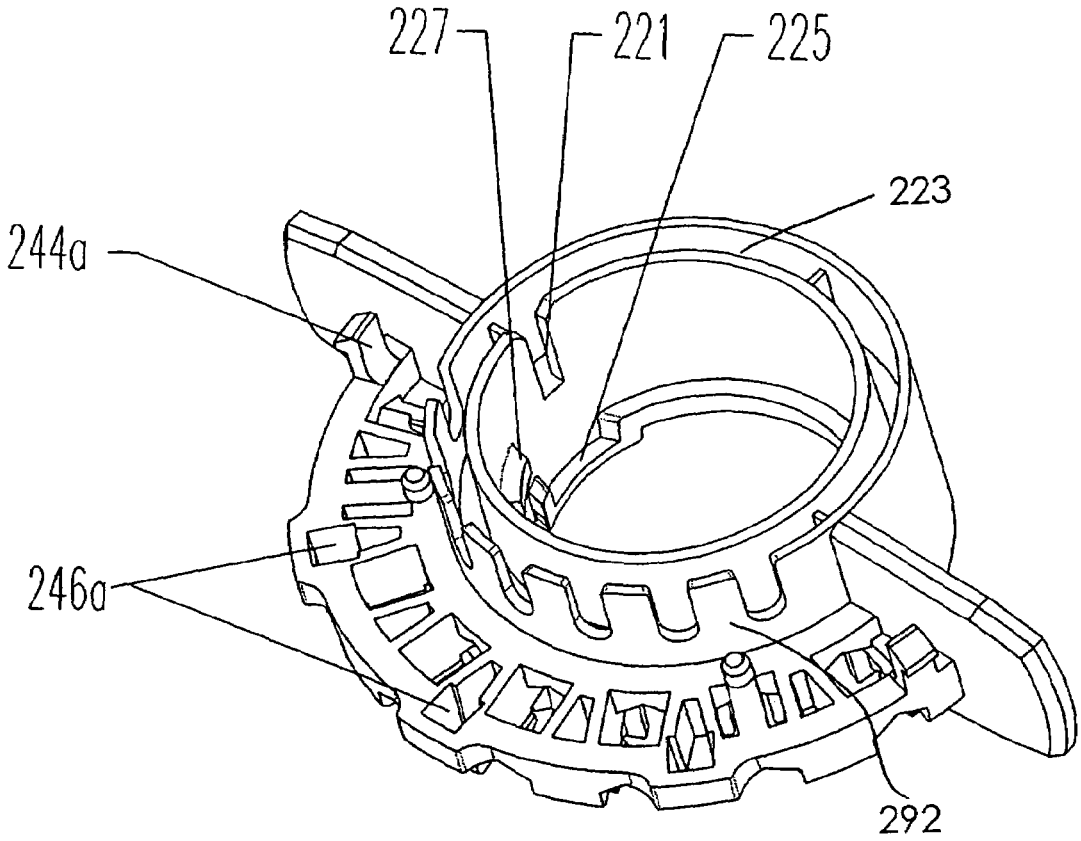
FIG. 9 shows in isolation the main body of the embodiments of the invention.

The bit holder 2 comprises a generally cylindrical main body 22 with a bore 222 and two diametrically opposed baffles 224 extending radially outwardly from the exterior wall (see in particular FIG. 9). Between the baffles 224 there is a partially castellated wall 292 of the main body 22. The inner periphery of the cylindrical main body 22 is provided with a cavity wall 223 having two end recesses 225 and an axial mounting slot 221 formed therein.

Opposed upper and lower semi-annular collars 24*a,b* are integral with the cylindrical main body 22 between the baffles 224. The collar 24*a* has a plurality of hooks 244*a* and slots 246*a* and the collar 24*b* has a plurality of corresponding slots 246*b* and hooks 244*b* to engage with the hooks 244*a* and slots 246*a*. Each of the upper and lower collars 24*a,b* comprises a plurality of radial pockets 242 equally spaced apart circumferentially in a common plane such that their axes intersect. The radial pockets 242 arranged in this way are able to receive more bits 8 than pockets arranged side-by-side in parallel. An annular slot 28 is formed between the cavity wall 223 and the castellated wall 292 of the cylindrical main body 22.

An elastically magnetic element 26 comprises a flexible arcuate rib 262 on which are mounted a plurality of circumferentially spaced apart magnets 264. The magnetic element 26 is mounted in the annular slot 28 such that the magnets 264 separately align with the ends of the radial pockets 242.

Referring to FIGS. 2 to 6, the bit holder 2 is received within the container 1 in such a way that the bore 222 is aligned with the apertures of the annuli 128*a,b* along a common axis a-a. The upper shaft element 14 and the lower shaft element 16 are inserted respectively through the aperture of the annulus 128*a* from the upper face 124 and the aperture of the annulus 128*b* from the lower face 126 so that the tangs 144 engage the slots 166 in the bore 222. A first end of the torsion spring 4 is connected to the column 164 whilst a second end of the torsion spring 4 hooks on to the mounting slot 221 to rotationally bias the bit holder 2 about the axis a-a to a position outside the container 1 (see FIG. 2).

The control device 3 extends through the ring-shaped body 142 into the bore 222 and comprises an externally accessible press-button plate 32 with two outward projections 322 which are able to selectively disengage the two end recesses 225. A spring 34 is fixed between the press-button plate 32 and the lower shaft element 16 for urging the press-button plate 32 upwards and the outward projections 322 into engagement with the recesses 225. When the press-button 32 is pressed downwards to overcome the biasing force of the spring 34, the projections 322 disengage the recesses 225 to permit the bit holder 2 to be rotated about axis a-a so that the bits 8 move rotationally into or out of the compartment 222 (see FIGS. 2 and 3). Rotation of the bit holder 2 is delimited by engagement between a protrusion 227 on the inner periphery of the cavity wall 223 and a corresponding protrusion 168 on the lower shaft element 16. This prevents the bit holder 2 from freely rotating in the container 1.

The clip 5 is connected to the bottom cover 16 by a screw 90 for convenient portability.

Figure 7:
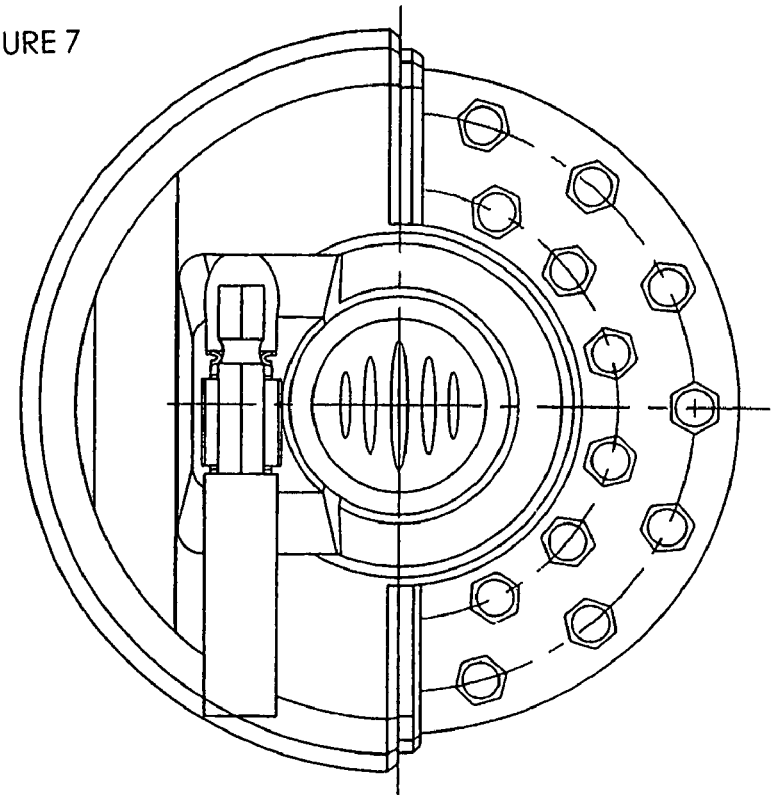
FIGS. 7 and 8 show a second embodiment of the present invention.
Figure 8:
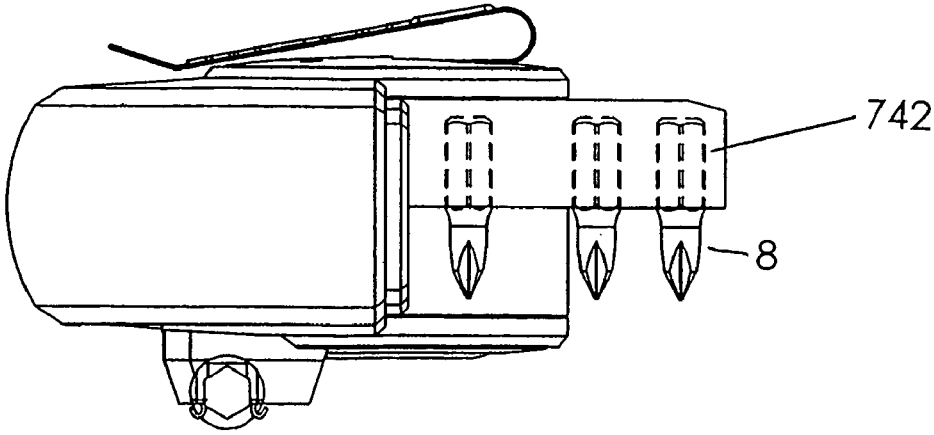

FIGS. 7 and 8 illustrate an alternative embodiment in which the pockets 742 are disposed axially (compared with radially outwardly as in the first embodiment (see 242)).

The invention claimed is:

1. A storage box for storing a plurality of bits comprising:

a container having at least one annulus defining an aperture and bound by a substantially semi-toroidal casing defining a compartment;

a bit holder comprising a generally cylindrical main body with a bore and a plurality of pockets for receiving bits, wherein the bit holder is received within the container such that the bore is aligned with the aperture of the at least one annulus along a common axis, wherein the bit holder comprises at least one collar bearing the plurality of pockets in a common plane;

a part of the cylindrical main body is a castellated wall and an inner periphery of the cylindrical main body is provided with a cavity wall, wherein an annular slot is formed between the cavity wall and the castellated wall, wherein at least one magnetic element is received in the annular slot for magnetizing the bits; and a control device received within the bore and biased into rotationally restrained engagement with the bit holder, wherein the control device is selectively disengageable from the bit holder so that the bit holder is rotational about the common axis to move the pockets rotationally in and out of the compartment.

2. The storage box according to claim 1 wherein the pockets are outwardly radial or axial.

3. The storage box according to claim 1 wherein the at least one annulus includes a pair of substantially coaxial annuli each defining an aperture and bound by the substantially semi-toroidal casing defining the compartment, wherein the bit holder is received within the container such that the bore is aligned with each aperture of the pair of annuli along the common axis.

4. The storage box according to claim 2, wherein the plurality of pockets are arranged radially such that their axes intersect.

5. The storage box according to claim 1, wherein the at least one magnetic element comprises a flexible rib on which are mounted a plurality of spaced apart magnets.

6. The storage box according to claim 1, wherein the control device comprises a press-button plate movable along the common axis so as to selectively engage or disengage the bit holder.

7. The storage box according to claim 6, wherein one of the press-button plate and the bit holder is provided with a projection and the other of the press-button plate and the bit holder is provided with a recess, wherein the press-button plate is movable axially relative to the bit holder in the bore to selectively engage or disengage the projection and the recess.

8. The storage box according to claim 1 further comprising:

an elastic torsion element disposed between the container and the bit holder.

9. The storage box according to claim 3 wherein the pair of annuli includes an upper annulus and a lower annulus and the storage box further includes an upper shaft element mounted through the upper annulus of the pair of annuli and a lower shaft element mounted through the lower annulus of the pair of annuli so as to engage the upper shaft element.

10. The storage box according to claim 9 wherein the upper shaft element comprises a partial ring-shaped body with a plurality of circumferentially spaced apart tangs extending axially therefrom.

11. The storage box according to claim 10 wherein the lower shaft element comprises a disc-shaped body from which axially extends a column defining a plurality of radial protrusions spaced apart to be engageable with the tangs.

12. The storage box according to claim 1 further comprising:

two diametrically opposed baffles extending radially outwardly from an exterior wall of the generally cylindrical main body of the bit holder.

13. The storage box according to claim 12 further comprising:

opposed upper and lower semi-annular collars connected to or integral with the cylindrical main body between the baffles.

14. The storage box according to claim 13 wherein each of the upper and lower collars comprises a plurality of radial pockets equally spaced apart circumferentially such that their axes intersect.

15. The storage box according to claim 14 wherein a part of the cylindrical main body between the baffles is a castellated wall and the inner periphery of the cylindrical main body is provided with a cavity wall, wherein an annular slot is formed between the cavity wall and the castellated wall, wherein at least one magnetic element is received in the annular slot for magnetizing the bits.

16. The storage box according to claim 15 further comprising:

a flexible rib on which are mounted a plurality of spaced apart magnets, wherein the flexible rib is mounted in the annular slot such that the magnets separately align with the ends of the radial pockets.

17. The storage box according to claim 11 wherein the inner periphery of the cylindrical main body of the bit holder is provided with the cavity wall having two end recesses and a mounting slot formed therein.

18. The storage box according to claim 17 further comprising:

an elastic torsion element, wherein a first end of the elastic torsion element is connected to the column and a second end of the elastic torsion element is fixed on to the mounting slot to rotationally bias the bit holder about the common axis to a position outside the container.

19. The storage box according to claim 18 wherein the control device extends through the ring-shaped body into the bore and comprises:

a press-button plate with two outward projections which are able to selectively disengage the two end recesses.

20. The storage box according to claim 19 further comprising:

an elastic element disposed axially between the press-button plate and the lower shaft element for biasing the press-button plate upwards and the outward projections into engagement with the recesses, wherein when the press-button plate is pressed downwards to overcome the biasing of the elastic element, the projections disengage the recesses to permit the bit holder to be rotated about the common axis so that the pockets move rotationally into or out of the compartment.

21. A storage box for storing a plurality of bits comprising:

a container having at least one annulus defining an aperture and bound by a substantially semi-toroidal casing defining a compartment;

a bit holder comprising a generally cylindrical main body with a bore and a plurality of pockets for receiving bits, wherein the bit holder is received within the container such that the bore is aligned with the aperture of the at least one annulus along a common axis;

a control device received within the bore and biased into rotationally restrained engagement with the bit holder, wherein the control device is selectively disengageable from the bit holder so that the bit holder is rotational about the common axis to move the pockets rotationally in and out of the compartment;

two diametrically opposed baffles extending radially outwardly from an exterior wall of the generally cylindrical main body of the bit holder;

opposed upper and lower semi-annular collars connected to or integral with the cylindrical main body between the baffles with each of the upper and lower collars comprising a plurality of radial pockets equally spaced apart circumferentially such that their axes intersect; and a part of the cylindrical main body between the baffles is a castellated wall and an inner periphery of the cylindrical main body is provided with a cavity wall, wherein an annular slot is formed between the cavity wall and the castellated wall, wherein at least one magnetic element is received in the annular slot for magnetizing the bits.

22. A storage box for storing a plurality of bits comprising:

a container having at least one annulus defining an aperture and bound by a substantially semi-toroidal casing defining a compartment with the at least one annulus including a pair of substantially coaxial annuli each defining an aperture and bound by the substantially semi-toroidal casing defining the compartment with the pair of annuli including an upper annulus and a lower annulus;

a bit holder comprising a generally cylindrical main body with a bore and a plurality of pockets for receiving bits, wherein the bit holder is received within the container such that the bore is aligned with each aperture of the pair of annuli along the common axis;

an inner periphery of the cylindrical main body of the bit holder is provided with a cavity wall having two end recesses and a mounting slot formed therein;

a control device received within the bore and biased into rotationally restrained engagement with the bit holder, wherein the control device is selectively disengageable from the bit holder so that the bit holder is rotational about the common axis to move the pockets rotationally in and out of the compartment;

an upper shaft element mounted through the upper annulus of the pair of annuli and a lower shaft element mounted through the lower annulus of the pair of annuli so as to engage the upper shaft element with the upper shaft element comprising a partial ring-shaped body with a plurality of circumferentially spaced apart tangs extending axially therefrom and the lower shaft element comprising a disc-shaped body from which axially extends a column defining a plurality of radial protrusions spaced apart to be engageable with the tangs; and an elastic torsion element, wherein a first end of the elastic torsion element is connected to the column and a second end of the elastic torsion element is fixed on to the mounting slot to rotationally bias the bit holder about the common axis to a position outside the container.

* * * * *

UNITED STATES PATENT AND TRADEMARK OFFICE

CERTIFICATE OF CORRECTION

PATENT NO. : 7,624,866 B2
APPLICATION NO. : 11/405246
DATED : December 1, 2009
INVENTOR(S) : Qibin Wang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 645 days.

Signed and Sealed this

Twenty-sixth Day of October, 2010

David J. Kappos

David J. Kappos
*Director of the United States Patent and Trademark Office*